United States Patent [19]

Burnes

[11] 4,248,431

[45] Feb. 3, 1981

[54] GOLFING AID

[76] Inventor: Donald A. Burnes, 771 E. Wrenwood La., Fresno, Calif. 93710

[21] Appl. No.: 21,977

[22] Filed: Mar. 19, 1979

[51] Int. Cl.[3] ..... A63B 69/36

[52] U.S. Cl. ..... 273/187 R

[58] Field of Search ..... 273/187 R, 187 A, 187 B, 273/195 R, 186 C; 35/29 A

[56] References Cited

U.S. PATENT DOCUMENTS

| | | | |
|---|---|---|---|
| 2,189,613 | 2/1940 | Paulsen | 273/187 R |
| 2,457,351 | 12/1948 | Crowley | 273/187 R |
| 2,606,026 | 8/1952 | Young | 273/187 R |
| 3,868,109 | 2/1975 | Fowler | 273/186 C X |
| 4,164,352 | 8/1979 | O'Brien | 273/187 A |

FOREIGN PATENT DOCUMENTS

| | | | |
|---|---|---|---|
| 261328 | 5/1963 | Australia | 273/187 R |
| 1063586 | 3/1967 | United Kingdom | 273/187 R |

*Primary Examiner*—George J. Marlo
*Attorney, Agent, or Firm*—Huebner & Worrel

[57] ABSTRACT

A golfing aid which includes a base mat having a target line aligned with an intended course of travel for a golf ball and an approach line obliquely angularly related to the target line and intersecting it adjacent to a predetermined tee position of the ball; an approach mat slidably rested on the base mat for movement along the approach line and provided with indicia for indicating dispositions of the feet assumed in approaching the ball; a pair of foot mats slidably rested on the approach mat defining a disposition of the feet for addressing the ball; and devices releasably securing the mats in selected relative positions.

7 Claims, 4 Drawing Figures

GOLFING AID

BACKGROUND OF THE INVENTION

1. Field of the Invention

The present invention relates to a golfing aid, and more particularly to such an aid for practicing the proper stance for addressing a golf ball.

2. Description of the Prior Art

It is well known that proper "address" of a golf ball, or how a golfer stands in relation to the ball, is one of the most important and difficult tasks that a successful golfer must perform. This is, of course, because the address ultimately determines in large measure where a struck ball will go. The address controls a number of factors, such as the path in which a golf club is swung, which in turn determines whether a struck golf ball will travel straight or will be "hooked" or "sliced".

It has long been recognized that an aid for training a golfer in assuming the proper address would be highly desirable. Although the basic angle of approaching a golf ball in relation to its desired course is constant, the relative disposition of the feet in relation to the ball varies with the physique of the golfer, the particular golf club being used for a "shot", and any desired variation of the course of the ball from a straight line. Therefore, such an aid not only must provide for approaching the ball at the basic angle, but must be adjustable to provide the necessary range of variations in said disposition. Since considerable time and experimentation may be required to determine such a disposition, it is desirable that any movable indicia indicating such a disposition be convenient to reposition in a previously determined position. It is, of course, necessary that such indicia not move while a particular addressing stance is being practiced. However, it is highly desirable that such indicia be readily movable to a position indicating a different stance.

To be practical, a golfing aid for training in addressing the ball must not only effectively indicate the proper address, but it must be useful in a wide range of environments varying from the home to a golf course. As a result, it is highly desirable that such an aid be portable and, for transportation and storage, that it be capable of being stowed compactly.

PRIOR ART STATEMENT

In conformance with 37 C.F.R. 1.97 and 1.98, the applicant states that he is not aware of any prior art which is relevant to the patentability of the subject invention.

SUMMARY OF THE INVENTION

It is an object of the present invention to provide an improved golfing aid for training a golfer in the proper foot positions for addressing a golf ball.

Another object is to provide such an aid which indicates successive positions for the feet in approaching and in addressing the ball.

Another object is to provide such an aid which is adjustable so as to indicate various such positions required by golfers of different physiques, by the use of different clubs, by differences in the distances to the target, by intentional departures of the course of the ball from a straight line, and the like.

Another object is to provide such an aid having movable indicia which are adjustable to indicate a selected one of such addressing positions, which are releasably retained in such a selected position and which can be easily moved to other positions.

Another object is to provide such a golfing aid for use in a variety of golfing and golf practicing environments, the aid being convenient to transport between such environments and to store when it is not in use.

Another object is to provide such an aid which can be utilized with or without a golf ball and/or a tee for the ball.

A further object is to provide a golfing aid which is economical, durable, and fully effective in carrying out its intended purposes.

DESCRIPTION OF THE PREFERRED EMBODIMENT

Figure 1:
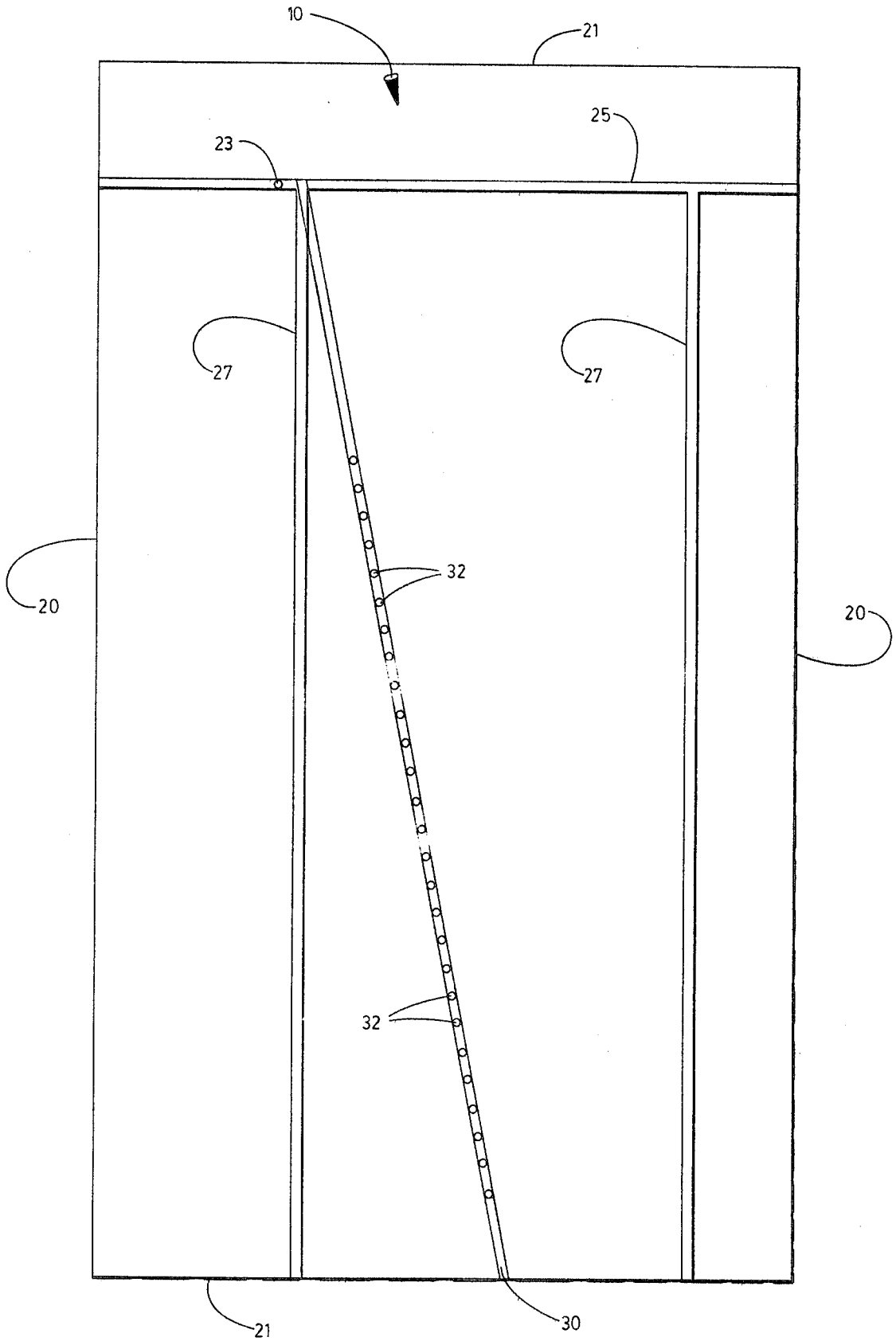
FIG. 1 is a plan view of a base mat utilized in a golfing aid embodying the principles of the present invention.

Referring now with greater particularity to the drawings, a first or base mat 10 embodying the principles of the golfing aid of the present invention is best shown in FIG. 1. The base mat is utilized in combination with a second or address mat 12, best shown in FIG. 2, and with a left foot mat 14 and a right foot mat 16 which are best shown in FIG. 3. The mats are illustratively configured for use by a right-handed golfer. However, the necessary differences between this configuration and that required for a left-handed golfer will be readily apparent to one skilled in the art.

The base mat 10 is constructed from a rectangular sheet of flexible material such as sheet rubber, sheet plastic, paper or the like. The mat has a pair of longitudinally extending edges 20 and a pair of transversely extending edges 21. Illustratively, the mat is preferably approximately one hundred and thirty-seven centimeters (fifty-four inches) in length and eighty-one centimeters (thirty-two inches) in width. The mat is provided with an opening 23 which defines a tee position for a golf ball. This opening extends vertically through the mat and is adapted to receive a well-known golf tee extended therethrough. The opening is disposed adjacent to one corner of the mat. Preferably, the opening is spaced approximately thirteen centimeters (five inches) longitudinally from one of the longitudinally extending edges and is spaced approximately twenty centimeters (eight inches) transversely from one of the transversely extending edges. The upper side of the mat is provided with a target stripe 25. This stripe extends across the mat substantially parallel to its transversely extending edges and intersects said opening 23. This stripe defines a target line for the mat. The mat has a pair of shoulder stripes 27 which are parallel to its longitudinal edges and which extend the length of the mat. One of these stripes is spaced approximately two centimeters (thirteen-sixteenths of an inch) from said opening in a direction away from the adjacent longitudinally extending edge. The other of these stripes is spaced from said one stripe approximately the width of the shoulders of a golfer, forty-six centimeters (eighteen inches) typically.

The target and shoulder stripes are provided in any suitable manner, such as by embossing or printing in a color contrasting with the balance of the mat.

The mat 10 is provided with an approach stripe 30 which is obliquely angularly related to both the target stripe 25 and the shoulder stripes 27. The approach stripe extends from the intersection of said one of the shoulder stripes with the target stripe, adjacent to the opening 23, longitudinally of the mat to the opposite transverse edge 21 of the mat. The approach stripe defines a first approach line and is delineated in the manner of the target and shoulder stripes. The approach stripe indicates the intersection with the mat of a vertical plane extending centrally through a golfer's body between the back and front thereof while the golfer is addressing the ball. The acute angle between the approach stripe and the target stripe is disposed oppositely of the tee opening 23 in relation to said one of the shoulder stripes. This angle can, of course, be of any desired value. However, it is preferable that this angle be approximately seventy-nine degrees so that the angle between said one of the shoulder stripes and the approach stripe is approximately eleven degrees. The mat is provided with a plurality of substantially identical positioning openings 32 which are substantially equally spaced along the approach stripe and which extend vertically through the mat. Preferably, these openings are disposed along said stripe from a point thereon approximately thirty centimeters (twelve inches) from the edge 21 adjacent to the tee opening substantially to the opposite edge.

Figure 2:
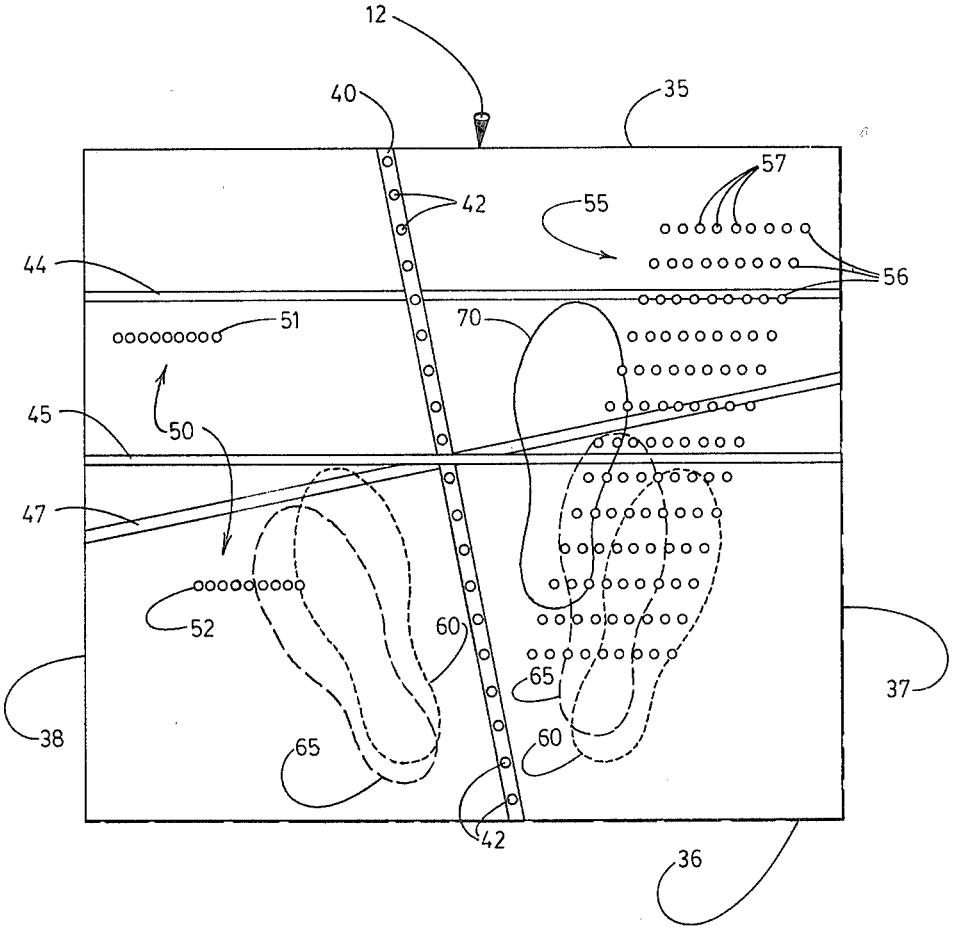
FIG. 2 is a plan view of an approach mat utilized in combination with the base mat.
Figure 3:
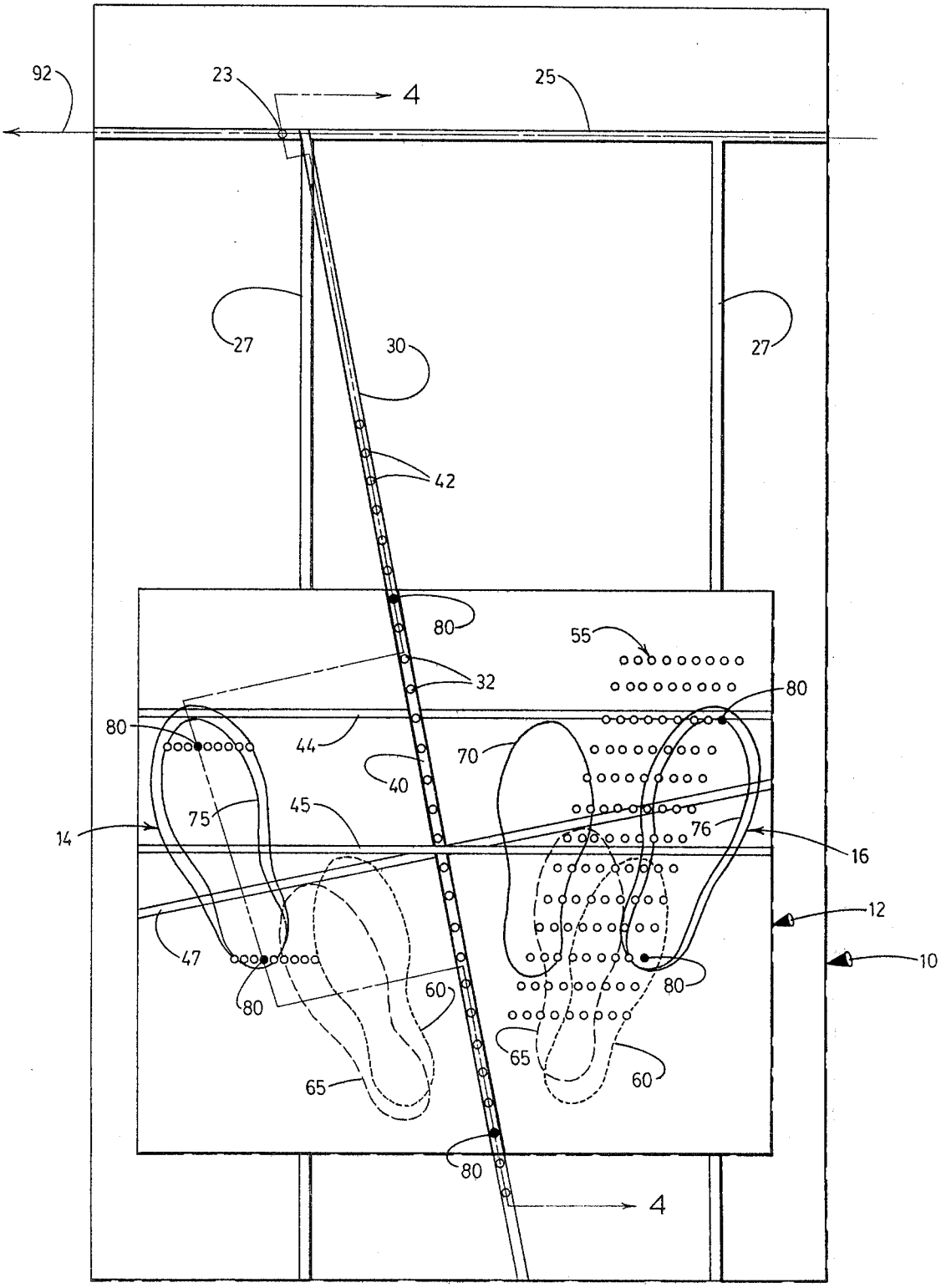
FIG. 3 is a plan view showing said mats together with a pair of foot mats in a representative operative relation.

The address mat 12 best shown in FIG. 2 is rectangular and is made from material similar to that from which the base mat 10 is made. The width of the address mat is approximately equal to the width of the base mat. However, the preferable length of the address mat is substantially less than the width of the base mat, approximately sixty-one centimeters (twenty-four inches). The address mat has a predetermined transversely extending forward edge 35 and an opposite rearward edge 36. Said mat has a predetermined longitudinally extending right-hand edge 37 and has an opposite left-hand edge 38.

The address mat 12 is provided with an approach stripe 40 extending between and in angular relation to its forward edge 35 and its rearward edge 36. This stripe defines a second approach line. The acute angle between the stripe and the edges is substantially equal to the acute angle between the approach stripe 30 of the base mat 10 and its target stripe 25. The approach stripe of the address mat is provided with a plurality of circular openings 42 which extend through the mat and have a diameter and spacing substantially identical to those of the openings 32 in the base mat. The address mat is provided with a transversely extending forward stripe 44 and a parallel rearward stripe 45. The rearward edge of the forward stripe intersects the one of the openings 42 which is spaced approximately one-fourth of the length of the address mat from its forward edge 35. The rearward stripe 45 is spaced approximately fifteen centimeters (six inches) toward the rearward edge 36 of the mat from the forward stripe so that the rearward stripe intersects the approach stripe 40 centrally of the mat. The address mat is provided with a reference stripe 47 which extends across the mat in a direction normal to the approach stripe at its intersection with the rearward parallel stripe. The approach stripe, forward stripe, rearward stripe and reference stripe are conveniently designated in the same manner as the stripes 25, 27 and 30 of the base mat.

The address mat 12 is provided with a plurality of left positioning openings 50. These openings are circular, having substantially the same diameter as the openings 42, and extend vertically through the mat. These positioning openings are disposed in transversely equally spaced relation along a forward row 51 and in a rearward row 52. These rows are substantially parallel to the stripes 44 and 45. Each row, preferably, has nine openings spaced approximately on six millimeter (one-fourth inch) centers. The forward row is disposed in rearwardly adjacent relation to the forward stripe, and the rearward row is spaced approximately twenty-five centimeters (ten inches) longitudinally of the mat from the forward row. The rearward row is disposed toward the longitudinal centerline of the mat from the forward row so that corresponding openings of each row lie along a line which is obliquely related to the left-hand edge 38 of the mat. The acute angle between said line and said edge is substantially equal to the angle at which one foot turns outward from the centerline of the body when walking normally, typically, eighteen degrees approximately. Said line intersects the rearward edge of the forward parallel stripe at a point which, preferably, is spaced from its intersection with the approach stripe 40 a distance somewhat greater than one-half the width of the shoulders of a golfer who is to use the mat. Typically, this spacing is about twenty-five centimeters (ten inches) for a golfer having a shoulder width of forty-six centimeters (eighteen inches).

The address mat 12 is also provided with a plurality of right positioning openings 55 located in a region between the approach stripe 40 and the edge 37. Each of these openings is substantially identical to the openings 42. The right openings are disposed in a plurality of rows 56 which are parallel to the forward stripe 44. Each row has an equal number of equally spaced openings. Preferably, each row has nine openings spaced on sixteen millimeter (five-eighth inch) centers. Transversely of the mat, each row is individually aligned with a respective opening 42 of the approach stripe. Preferably, the forwardmost row is aligned with the second of said openings forward of the forward stripe and the rearwardmost row is aligned with the tenth of said openings rearwardly of said stripe. Said rows, from the rearwardmost to the forwardmost, are disposed successively closer to the right-hand edge 37 of the mat. This disposition of the rows is such that corresponding openings of the rows lie in a plurality of parallel columns 57 which are obliquely related to said edge. The acute angle between each column and said edge is substantially equal to the angle the feet diverge from the centerline of the body in a normal walking position. This angle, as described previously in connection with the openings 50, is approximately eighteen degrees. Preferably, the outwardly disposed opening of the one of said rows 56 along the forward stripe 44 is spaced approximately fifty-eight centimeters (twenty-three inches) from the intersection of said stripe with a line through each of the outwardly disposed openings 42 of the rows 51 and 52.

The address mat 12 is provided with a pair of first footprint-shaped indicia 60 indicated in the drawings by relatively short dashed lines. Each first indicia is disposed with its toe end touching the rearward parallel stripe 45. These indicia are located in the positions occupied by the feet of a person standing in a position facing in a direction normal to said stripe. The toe ends of the indicia thus diverge from the heel ends at an included angle of approximately thirty-six degrees. Preferably, the indicia are spaced equally in opposite directions transversely of the mat from the next to the rearwardmost of the openings 42. The indicia are delineated on the mat in any suitable manner.

The address mat 12 is provided with a pair of second footprint-shaped indicia 65 indicated in the drawings by relatively longer dashed lines. The size, relative position, and construction of these indicia are substantially identical to those of the first footprint indicia 60. However, the second indicia have been rotated counterclockwise from the positions of the first indicia so that the toe ends of the second indicia touch the reference stripe 47.

The address mat 12 has a single footprint-shaped indicia 70 depicted in the drawings by a solid line and representing a single right footprint disposed with its toe end touching the forward stripe 44. This indicia is in the position of a foot which has moved forward parallel to the approach stripe 40 from the position of right footprint of the second indicia 65 until the toe touches the forward stripe.

The left foot mat 14 and the right foot mat 16 are made of flexible material similar to that from which the base mat 10 and the address mat 12 are made. As shown in FIG. 3, the foot mats are in the general shape of footprints, and are somewhat larger than the corresponding footprints of the indicia 60, 65, and 70. The left and right foot mats are provided with respective footprint-shaped indicia 75 and 76. These indicia are of substantially the same size and shape as the corresponding footprints 60, 65 and 70. The foot mats extend outwardly beyond their respective indicia except at their heel ends at which each mat and its footprint indicia coincide. Each foot mat is provided with a pair of circular openings 78 having substantially the same diameter as the openings 50 and 55 in the address mat 12. The pair of openings are disposed in spaced relation along the longitudinal centerline of the footprint-shaped indicia. Thus, one of said openings is adjacent to the toe end of the footprint and the other is adjacent to the heel end. The spacing between said openings is such that, when the foot mats are disposed on the address mat above the corresponding openings 50 or 55 with said centerlines diverging outwardly at an included angle of approximately thirty-six degrees, the pair of openings in each mat register with a corresponding pair of openings in the corresponding rows 51 and 52 or 56.

The golfing aid of the present invention includes six cylindrical pegs 80 which are slidably fitted to the openings 32, 42, 50, 55, and 78. The length of each peg is substantially equal to twice the thickness of each of the mats 10, 12, 14, and 16.

OPERATION

Figure 4:
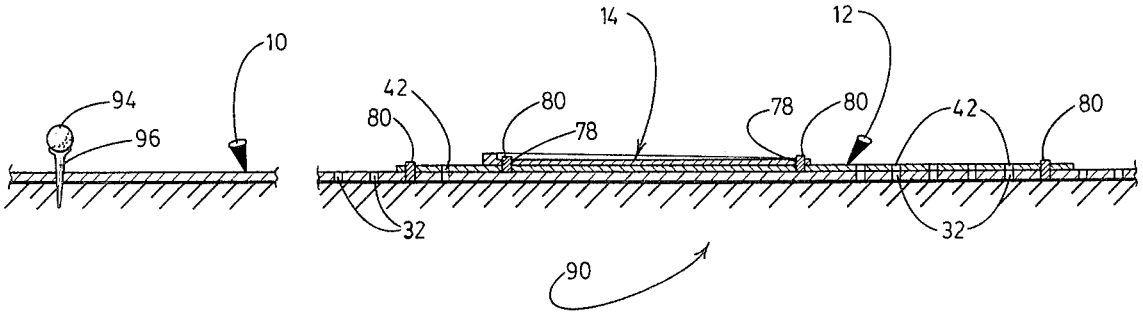
FIG. 4 is a vertical section taken on line 4—4 of FIG. 3.

The operation of the described embodiment of the golfing aid of the present invention is believed to be clearly apparent and is briefly summarized at this point. It is to be understood that the aid can be utilized in any environment in which practice in addressing a golf ball can be carried out. Such an environment, as depicted in FIGS. 3 and 4, has a substantially horizontal surface 90, such as the surface of a golf course, and has a desired course of travel, indicated by the arrow 92, along which a golf ball 94 is to be struck. The course of travel interconnects an initial position of the ball, indicated by a tee 96, with a target for the ball. As shown in FIG. 3, the target is disposed to the left of said position as indicated by said arrow. In indoor practice, the mat can be rested on a floor and any convenient direction can be selected for the simulated course of travel.

To use the golfing aid, the base mat 10 is placed flatly on the surface 90 with the target stripe 25 aligned with the course of travel 92 and with the tee opening 23 at the position of a golf ball 94 which is to be utilized in practicing addressing. If desired and where the environment permits, the ball can be supported by a tee 96 which is inserted through the opening into the surface 90. The address mat 12 is next positioned flatly on the base mat with the stripe 40 superimposed on the approach stripe 30, thereby aligning the approach lines by the stripes. The address mat is then slid along the base mat toward or from the target stripe, keeping the approach stripes in alignment, until the address mat is at a desired distance from the target stripe. This distance, of course, varies with the physique of a particular golfer and the nature of the "shot" for which addressing is being practiced. A pair of the positioning openings 42 in the address mat are then aligned with a corresponding pair of positioning openings 32 in the base mat by moving the address mat along the approach line of the base mat. Since the openings are relatively closely spaced, the desired distance is not significantly changed by this movement. The mats are then secured together to maintain this distance by inserting a peg 80 through each aligned pair of openings 32 and 42.

The left foot mat 14 is next flatly disposed on the address mat 12 and slid to a selected position relative to the mats 10 and 12 in which the left foot is to be disposed while addressing the ball 94. Normally in this position, the heel of the left foot is directly opposite the ball with the angle of the foot to a perpendicular to the forward parallel stripe 44 being approximately eighteen degrees. As a result, there is only a relatively limited range of proper positions for the left foot. The indicia 75 can be positioned substantially to indicate these positions by aligning the openings 78 with a selected pair of transversely corresponding openings 50 in the rows 51 and 52. When the left foot mat is positioned with said openings aligned in the manner described, the foot mat is secured to the address mat by inserting a pair of the pegs 80 through the openings.

The right foot mat 16 is next positioned relative to the base mat 10 and address mat 12 to indicate a selected disposition of the right foot in addressing the ball 94. The foot mat is positioned with its openings 78 aligned with an appropriate pair of the openings 55. The right mat is secured in this position by inserting a pair of the pegs 80 through the aligned pairs of openings. In any event, the line on which said openings in the foot mat are disposed diverges at approximately eighteen degrees from a perpendicular to the forward stripe 44. Due to the relative disposition of the pair of openings in the right mat in relation to the relative disposition of the rows 56 and columns 57 of the openings in the address mat, the right mat can only be secured to the address mat in this angular relation to the parallel stripe.

As is well known to golfers, there are various stances that can be assumed in addressing a ball. Such a stance is described as "square" if the body is substantially parallel with the course of travel 92, "open" if the body is rotated to the left from such a stance, and "closed" if rotated to the right from such a stance. In all such stances the left foot remains in its selected position indicated by the indicia 75 of the left mat 14, and the desired stance is assumed by moving the right foot only. A desired square stance is indicated by the indicia 76 when the right foot mat 16 is disposed with the opening 78 at its toe end aligned with one of the openings 55 in the one of the rows 56 thereof along the rearward edge of the forward parallel line 44. An open stance is indicated when said opening in the right mat is aligned with one of said openings in the address mat forward of said stripe. A closed stance is indicated when said right mat opening is aligned with one of said address mat openings disposed rearwardly of said stripe. The desired width of a square, an open, or a closed stance varies with the club being used and the distance to the target. A given width of stance is maintained when the openings in a single one of the columns 57 thereof are utilized. The desired width of stance is, therefore, selected by positioning the openings in the right foot mat in alignment with an appropriate pair of the openings in a selected one of said columns. The described arrangement of the openings 55 allows the right foot mat to be positioned to indicate substantially any proper stance for addressing the ball.

As is readily apparent, the left foot mat 14 and the right foot mat 16 can be conveniently moved to indicate other positions for the addressing of a golf ball 94 by pressing the pegs 80 from the respective openings 50 and 55 in the address mat and repositioning the mats for the new disposition. Similarly, the address mat can be conveniently repositioned in relation to the target stripe 25 by pressing the pegs 80 inserted in a pair of the openings 42 from said openings and sliding the address mat 12 on the base mat 10. It will be noted that the selected position of the feet indicated by the foot mats is not altered when the address mat is moved relatively to the base mat. Similarly, the indication of a selected disposition of one foot relative to the other need not be disturbed while the indicia corresponding to the other foot is altered. As a result, the described embodiment of the present invention permits experimentation with various aspects of addressing a golf ball without risk of losing desirable aspects already determined.

Because the left arm controls the swing and the left hand controls the club face, the address is built in an orderly manner around the left arm with the left hand in its natural position. The left arm must be moved out of its natural hanging position just enough to permit a free swing. The natural tendency of each part of the body cannot be ignored but must attain as natural a position as possible for a golf swing. The feet play a very important role in the address of a golf ball. The natural tendency is for the feet to assume a walking position. The left foot must be placed in a walking position relative to the target line 25 to enable the left leg to follow the movement of the left shoulder. The right foot must be placed in a walking position relative to the target line to enable the right leg to become an axis on which the hips can turn as they follow the movement of the left leg.

When the mats 10, 12, 14 and 16 are secured in their relative positions for practicing addressing the ball 94 with a particular selected disposition of the feet, the feet are first placed in their respective positions indicated by the first footprint indicia 60. This squares the body with the target line 25. The individual using the mats preferably holds a selected club, not shown, in his left hand with his left arm straight and with the face of the club confronting the ball 94. The club may also be gripped with the right hand in the usual manner, if desired. If the ball is too close or too distant for comfort the address mat 12 is adjusted along the approach stripe 30, as desired.

The feet are then moved, beginning with the right foot, to their respective positions indicated by the second footprint indicia 65. This movement positions the body so as to face along the approach stripes 30 and 40 at the proper angle to the course of travel 92 and to the target stripe 25. The left foot is then moved to its final position, as indicated by indicia 75 on the left mat 14. The right foot is next moved to the position indicated by the third footprint indicia 70. It will be noted that, due to the angular relation of said indicia to the target stripe, the positions of the feet are in the directions normally taken in walking so that the overall disposition of the golfer's body remains natural and relaxed. These positions are thus assumed by normal walking movements along the approach stripes 30 and 40 from the second footprint indicia to the final position for the body to address the ball 94. Finally, the right foot is moved to its position indicated by the indicia 76 of the right foot mat 16. This movement, in which the disposition of the left foot and the angle of the right foot to the target stripe are unchanged, does not twist the body out of a relaxed position in relation to the feet. As a result, the movements of a golf stroke taken from a position assumed in the manner described do not veer from the desired path. The golfer then takes a number of practice swings and repeats the procedure until proper addressing and proper swinging becomes habitual.

When the mats 10, 12, 14 and 16 have been utilized in a practice session for addressing a golf ball, they can be released from their relative positions by pressing the pegs 80 from their respective openings. The mats can then be stacked, folded, or rolled in any desired manner for transportation or for storage until it is again desired to engage in another session of practicing the addressing of a golf ball.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A golfing aid for use in practicing addressing a golf ball having an intended course of travel comprising:

A. a base mat having a predetermined position for a golf ball, a target line aligned with said position and with the intended course of travel, and a first approach line obliquely angularly related to the target line intersecting the target line adjacent to the ball position;

B. an address mat rested on the base mat having a second approach line superimposed on the first approach line on the base mat and coincident therewith, said address mat being adjustably positionable toward and from the ball position with the approach lines substantially aligned; and C. a pair of foot mats adjustably positioned on the address mat in predetermined selected positions to designate typical dispositions of the feet of a person addressing the ball corresponding to various stances desired.

2. The aid of claim 1 including means for releasably securing the foot mats to the address mat.

3. The aid of claim 1 wherein the address mat is slidably mounted on the base mat and the foot mats are slidably mounted on the address mat.

4. A golfing aid for use in addressing a golf ball to hit it along a predetermined path of travel comprising:

A. a base mat having a target stripe adapted to be aligned with said path of travel, a ball position designated on the target stripe, a pair of substantially parallel shoulder stripes substantially right-angularly extended from the target stripe, one thereof intersecting the target stripe in adjacent relation to the ball position, an approach stripe intersecting the intersection of the target stripe and said one of the shoulder stripes and diverging acutely therefrom;

B. an address mat having an approach stripe positionable on the base mat in spaced relation to the target stripe with the approach stripe of the address mat aligned with the approach stripe of the base mat for adjustable positioning of the address mat toward and from the target stripe of the base mat while maintaining the approach stripes in alignment;

C. left and right foot mats having simulated left and right footprint indicia thereon adjustably positioned on the address mat on opposite sides of the approach stripe;

D. means releasably securing the address mat in adjusted position on the base mat; and E. means releasably securing the foot mats in adjusted positions on the address mat whereby a golfer may adjust the address mat on the base mat and the foot mats on the address mat in accordance with his own preference and repetitively practice addressing a golf ball in the ball position on the base mat under constant conditions.

5. A golfing aid for use in addressing a golf ball to impel it along an intended path of travel comprising:

A. a base mat having a target stripe adapted to be aligned with said course of travel, a ball position designated on the target stripe, a shoulder stripe substantially right-angularly extended from the target stripe intersecting the target stripe in adjacent relation to the ball position, an approach stripe intersecting the intersection of the target stripe and the shoulder stripes and acutely diverging therefrom;

B. an address mat having an approach stripe positionable on the base mat with the approach stripes aligned for adjustable positioning of the address mat on the base mat toward and from the target stripe of the base mat while maintaining the approach stripes in alignment, a forward stripe extended across the address mat in spaced relation to the target stripe and substantially right-angularly related to the shoulder stripe, a rearward stripe substantially parallel to the forward stripe extended transversely of the approach stripe, a reference stripe extended transversely of the intersection of the rearward stripe and the approach stripe in substantially right-angular relation to the approach stripe, left and right simulated footprint first indicia on opposite sides of the approach stripe having toe portions at the rearward stripe to square a golfer standing with his feet in the first indicia with the target stripe on the base mat, left and right simulated footprint second indicia on opposite sides of the approach stripe having toe portions at the reference stripe to cause a golfer standing with his feet in the second indicia to face along the approach stripes, a right simulated footprint third indicia on the right side of the approach stripes having a toe portion at the forward stripe;

C. left and right foot mats having simulated left and right footprint indicia thereon adjustably positioned on the address mat on opposite sides of the approach stripe having toe portions at the forward stripe, the successive positioning of a golfer's feet in said first, second, third and final indicia serving to guide the golfer in a normal walking movement to adjusted ball addressing position;

D. means releasably securing the address mat in adjusted position on the base mat; and E. means releasably securing the foot mats in adjusted positions on the address mat whereby a golfer may adjust the address mat on the base mat and the foot mats on the address mat in accordance with his own preference and repetitively practice the resultant guided approach and addressing of the golf ball.

6. A golfing aid for use in addressing a golf ball to impel it along a predetermined path of travel comprising:

A. a base mat having a target stripe adapted to be aligned with said path of travel, a ball position designated on the target stripe, a pair of substantially parallel shoulder stripes spaced substantially the width of a golfer's shoulders and substantially right-angularly extended from the target stripe, one thereof intersecting the target stripe in adjacent relation to the ball position, an approach stripe intersecting the intersection of the target stripe and said one of the shoulder stripes and diverging acutely therefrom;

B. an address mat having an approach stripe positionable on the base mat with the approach stripes aligned for adjustable positioning of the address mat toward and from the target stripe of the base mat while maintaining the approach stripes in alignment, a forward stripe extended across the address mat in spaced relation to the target stripe and substantially right-angularly related to the shoulder stripes, a rearward stripe substantially parallel to the forward stripe extended transversely of the approach stripe, a reference stripe extended transversely of the intersection of the rearward stripe and the approach stripe in substantially right-angular relation to the approach stripe, left and right simulated footprint first indica on opposite sides of the approach stripe having toe portions at the rearward stripe to square a golfer standing with his feet in the first indicia with the target stripe on the base mat, left and right simulated footprint second indicia on opposite sides of the approach stripe having toe portions at the reference stripe to cause a golfer standing with his feet in the second indicia to face along the approach stripes at an acute angle to the target stripe, a right simulated footprint third indicia on the right side of the approach stripes having a toe portion at the forward stripe;

C. left and right foot mats having simulated left and right footprint final indicia thereon adjustably positioned on the address mat on opposite sides of the approach stripe having toe portions at the forward stripe, the successive positioning of a golfer's feet in said first, second, third and final indicia serving to guide the golfer in a normal walking movement to adjusted ball addressing position;

D. means releasably securing the address mat in adjusted position on the base mat; and E. means releasably securing the foot mats in adjusted positions on the address mat whereby a golfer may adjust the address mat on the base mat and the foot mats on the address mat in accordance with his own preference and repetitively practice the resultant guided approach and address of the golf ball.

7. The golfing aid of claim 6 in which the angle between the approach stripe and said one of the shoulder stripes is substantially 11°.

* * * * *